US011443876B2

(12) United States Patent
Sun et al.

(10) Patent No.: US 11,443,876 B2
(45) Date of Patent: Sep. 13, 2022

(54) VARISTOR COMPONENT AND METHOD FOR SECURING A VARISTOR COMPONENT

(71) Applicant: EPCOS AG, Munich (DE)

(72) Inventors: Shaoyu Sun, Zhuhai (CN); Xiaojia Tian, Zhuhai (CN); Rongguang Zhang, Zhuhai (CN)

(73) Assignee: TDK Electronics AG, Munich (DE)

( * ) Notice: Subject to any disclaimer, the term of this patent is extended or adjusted under 35 U.S.C. 154(b) by 106 days.

(21) Appl. No.: 16/093,579

(22) PCT Filed: Apr. 13, 2017

(86) PCT No.: PCT/EP2017/059027

§ 371 (c)(1),
(2) Date: Oct. 12, 2018

(87) PCT Pub. No.: WO2017/178631

PCT Pub. Date: Oct. 19, 2017

(65) Prior Publication Data

US 2020/0135368 A1 Apr. 30, 2020

(30) Foreign Application Priority Data

Apr. 14, 2016 (CN) ..... 201610232280.8

(51) Int. Cl.
*H01C 7/12* (2006.01)
*H01H 37/76* (2006.01)
(Continued)

(52) U.S. Cl.
CPC ..... *H01C 7/126* (2013.01); *H01H 37/761* (2013.01); *H01T 1/14* (2013.01); *H01T 4/08* (2013.01); *H01H 2037/762* (2013.01)

(58) Field of Classification Search
CPC ..... H01C 7/126; H01H 37/761; H01H 2037/762; H01T 1/14; H01T 4/08
(Continued)

(56) References Cited

U.S. PATENT DOCUMENTS 4,288,833 A * 9/1981 Howell ..... H02H 9/06 337/16
6,040,971 A * 3/2000 Martenson ..... H01C 7/12 361/103
(Continued)

FOREIGN PATENT DOCUMENTS

CN 1723595 A 1/2006
CN 101546910 A * 9/2009 ..... H01H 37/76
(Continued)

OTHER PUBLICATIONS

DE-102011053414-A1—English translation (Year: 2013).*

*Primary Examiner* — Anatoly Vortman
(74) *Attorney, Agent, or Firm* — Slater Matsil, LLP

(57) ABSTRACT

A varistor component and a method for securing a varistor component are disclosed. In an embodiment a varistor component includes a first external contact, a second external contact, a varistor electrically connected to the first external contact, a path between the varistor and the second external contact and an active releasing device having a shutter and a heat sensitive element, wherein, under abnormal operation conditions, the heat sensitive element releases the shutter, and the shutter moves along a straight line and closes the path between the varistor and the second external contact.

17 Claims, 5 Drawing Sheets

(51) Int. Cl.
*H01T 4/08* (2006.01)
*H01T 1/14* (2006.01)

(58) Field of Classification Search
USPC ..... 337/401
See application file for complete search history.

(56) References Cited

U.S. PATENT DOCUMENTS

| | | | | |
|---|---|---|---|---|
| 6,211,770 | B1 * | 4/2001 | Coyle | H01C 7/126 338/101 |
| 6,430,019 | B1 | 8/2002 | Martenson et al. | |
| 6,636,403 | B2 | 10/2003 | McLoughlin et al. | |
| 7,477,503 | B2 * | 1/2009 | Aszmus | H01C 7/126 361/103 |
| 7,741,946 | B2 | 6/2010 | Ho | |
| RE42,319 | E | 5/2011 | Martenson et al. | |
| 8,013,712 | B2 | 9/2011 | Cernicka | |
| 8,031,456 | B2 * | 10/2011 | Wang | H01T 1/14 361/118 |
| 8,378,778 | B2 | 2/2013 | Duval et al. | |
| 8,836,464 | B2 | 9/2014 | Wang | |
| 8,861,157 | B2 | 10/2014 | Ehrhardt et al. | |
| 9,007,163 | B2 * | 4/2015 | Duval | H01C 7/126 337/142 |
| 9,165,702 | B2 * | 10/2015 | Hagerty | H01C 7/126 |
| 9,570,260 | B2 * | 2/2017 | Yang | H01H 61/02 |
| 9,761,356 | B2 | 9/2017 | Hsu | |
| 10,325,703 | B2 * | 6/2019 | Sun | H01H 85/048 |
| 10,388,479 | B2 * | 8/2019 | Zhai | H01H 71/04 |
| 10,685,767 | B2 * | 6/2020 | Kamenšek | H01C 7/126 |
| 2001/0055187 | A1 | 12/2001 | McLoughlin et al. | |
| 2006/0145807 | A1 | 7/2006 | Gautier | |
| 2009/0027153 | A1 | 1/2009 | Ho | |
| 2009/0079535 | A1 | 3/2009 | Jeong et al. | |
| 2009/0161280 | A1 * | 6/2009 | Tseng | H01C 7/108 361/103 |
| 2010/0328016 | A1 | 12/2010 | Wang | |
| 2012/0068806 | A1 * | 3/2012 | Guarniere | H01C 7/10 337/1 |
| 2012/0105191 | A1 | 5/2012 | Wang | |
| 2013/0271890 | A1 | 10/2013 | Spalding | |
| 2014/0232512 | A1 | 8/2014 | Yang et al. | |
| 2015/0280420 | A1 | 10/2015 | Mao | |
| 2015/0372472 | A1 * | 12/2015 | Gautier | H02H 3/22 361/91.2 |
| 2016/0035523 | A1 * | 2/2016 | Daum | H01C 7/126 337/408 |
| 2016/0134104 | A1 * | 5/2016 | Mao | H02H 9/04 361/124 |

FOREIGN PATENT DOCUMENTS

| | | | | |
|---|---|---|---|---|
| CN | 203165599 | U | 8/2013 | |
| CN | 103997028 | A | 8/2014 | |
| DE | 102006052955 | A1 | 3/2008 | |
| DE | 102009004703 | A1 | 4/2010 | |
| DE | 102011053414 | A1 | 3/2013 | |
| DE | 102013202795 | B3 | 3/2014 | |
| DE | 102013022348 | A1 * | 7/2015 | H01H 37/761 |
| EP | 1077452 | A2 | 2/2001 | |
| EP | 2511915 | A1 | 10/2012 | |
| EP | 2725588 | A1 | 4/2014 | |
| EP | 2707892 | B1 | 6/2016 | |
| JP | S52-026932 | U | 2/1977 | |
| JP | S57201166 | U | 12/1982 | |
| JP | H0831299 | A | 2/1996 | |
| JP | 2010211928 | A | 9/2010 | |
| KR | 200462103 | Y1 | 8/2012 | |
| TW | 201618129 | A | 5/2016 | |
| WO | 2004027913 | A1 | 4/2004 | |
| WO | 2005112050 | A1 | 11/2005 | |
| WO | 2011102811 | A2 | 8/2011 | |

* cited by examiner

VARISTOR COMPONENT AND METHOD FOR SECURING A VARISTOR COMPONENT

This patent application is a national phase filing under section 371 of PCT/EP2017/059027, filed Apr. 13, 2017, which claims the priority of Chinese patent application 201610232280.8, filed Apr. 14, 2016, each of which is incorporated herein by reference in its entirety.

TECHNICAL FIELD

The present invention refers to varistor components with increased failure safety and to methods for securing varistor components under abnormal operation conditions.

BACKGROUND

Varistor components are electrical components having an electrical resistance that depends on the voltage applied to the component. It is possible that the resistance decreases with increasing applied voltage. A varistor component can have a resistance in the kΩ, MΩ or GΩ range when a voltage of a normal operation condition is applied to the component. If the applied voltage exceeds a critical voltage, then the component's resistance may be reduced to the range of a few ohm.

Such varistor components can be utilized as compensation elements in circuits or to protect sensitive circuits against excessive voltages. When used as a protection device, the varistor component can be electrically connected between a circuit and a ground potential and shunt potentially damaging electric power.

As a result, the electric power dissipating in varistor components may exceed critical values when the varistor component becomes low ohmic at high voltages and the dissipated power can destroy the varistor component or even destroy the whole electrical circuit, including the whole electrical device having the varistor component. When critical voltage conditions are exceeded, a varistor component may even catch fire.

From U.S. Publication No. 2001/0055187 A1, severally protected metal oxide varistor components are known. A varistor component comprises a fuse and an insulating gap can be created when the varistor component operates outside the normal operation conditions From U.S. Publication No. 2009/0027153 A1, further metal oxide varistor components are known. Again, a fuse is utilized to open the circuit to prevent further damage when the varistor component operates outside normal operation conditions However, known varistor components with a meltable material establishing a fuse cannot guarantee that the fuse's material maintains an electrical disconnection after melting. Especially in environmental conditions where the orientation of varistor components or where the components are subject to accelerations, the place where the material of the fuse will flow to is unknown and the risk of maintaining an electrical connection exists.

SUMMARY OF THE INVENTION

Embodiments provide a varistor component with improved safety. Further embodiments provide a varistor component that improves the probability of obtaining an open circuit under abnormal operation conditions and reduces the probability of material of a fuse to maintain an electrical contact.

Yet further embodiments provide a method of securing a varistor component in the case normal operation conditions are exceeded.

The varistor component may comprise a first external contact and a second external contact. Further, the varistor component comprises a varistor electrically connected to the first external contact. The component further has a path between the varistor and the second external contact. Further, the varistor component has an active releasing device with a shutter and heat-sensitive element. Under abnormal operation conditions the heat-sensitive element releases the shutter. Then, the shutter moves along a straight line and closes the path between the varistor and the second external contact.

The varistor can be any kind of varistor, e.g., a metal oxide varistor.

The first and the second external contact are provided to electrically connect the varistor component to an external circuit environment, e.g., as a shunting element between a ground potential and a sensitive electrical circuit to protect the sensitive electrical circuit from high voltage pulses.

The path between the varistor and the second external contact is the path where current may flow under normal operation conditions, i.e., between the first external contact and the second external contact while the respective voltage is applied to the varistor. The varistor and the path between the varistor and the second external contact may be electrically connected in series.

The active releasing device distinguishes the varistor component from the above-cited varistor component as a shutter and a heat sensitive element are provided and as the releasing device is an active device. There is no need to rely on the melted material of the fuse to condense at a non-harmful position. The releasing device actively closes the shutter and preferably prevents a galvanic connection between the varistor and the second external contact.

For each varistor component, normal operation conditions, e.g., according to the known specifications to be fulfilled, are defined. The heat sensitive element is structured in such a way and its material, especially the material's melting temperature, is chosen in such a way that if the defined normal operation conditions are exceeded, the shutter closes the path between the varistor and the second external contact and—preferably independent from the later resting position of the condensed material—the closed path prevents further current and galvanically separates the varistor from the second external contact.

The critical values between normal operation conditions and abnormal operation conditions leading to the activation of the releasing device can be found at UL1449, section 44.4, Limited current abnormal overvoltage test, valid on Mar. 26, 2015.

It is possible that the heat-sensitive element is arranged in the path and establishes an electrical connection between the varistor and the second external contact.

Then, by closing the path and electrically separating the varistor from the second external contact, the varistor is electrically decoupled from an external circuit environment and no further electrical power can be dissipated and the potential danger of the varistor component catching fire is strongly reduced.

However, during normal operation conditions, the heat-sensitive element acts as an electrical link between the varistor and the second external contact and couples the varistor to an external circuit environment that may be connected to the second external contact so that the varistor of the varistor component can act as a protection element to protect the corresponding external circuit environment.

It is possible that the heat-sensitive element is solid below a chosen temperature and melts, i.e., liquefies, above the critical temperature. The heat leading to the phase transition of the heat-sensitive element can be produced by energy dissipation within the heat-sensitive element having a finite ohmic resistance itself. However, it is also or additionally possible that the heat-sensitive element reacts due to heat produced in the varistor being arranged in the physical vicinity of the heat-sensitive element. Further, it is also possible that the varistor component contains an additional heat dissipating element such as an ohmic resistor to produce heat that melts the heat-sensitive element when abnormal operation conditions are reached.

Thus, it is possible that the heat-sensitive element is a fuse and has a conducting material with a melting point. The melting point can be below 230° C.

In particular, it is possible that the heat-sensitive element comprises a solder material with a corresponding melting temperature. The preferred melting temperature can be in between 185° C. and 230° C. A preferred corresponding material composition is a SnBi alloy or a SnAgCu solder paste or solder wire.

It is possible that the varistor component further comprises a functional element exerting a force onto the shutter, especially when the varistor component operates outside normal operating conditions. The functional element can be a spring, a thermos-expansion material or a memory metal.

Under normal operation conditions, the spring is arranged within the varistor component under tension. The heat-sensitive element is solid under normal operation conditions and blocks the shutter. Thus, the spring pushes to close the shutter but the solid heat-sensitive element keeps the shutter open and establishes an electrical connection between the varistor and the second external contact through the path.

When the temperature in the vicinity of the heat-sensitive element reaches a previously specified threshold, then the heat-sensitive element undergoes a transition into a liquid phase and cannot further withstand the spring's force. Correspondingly, in this instant the heat-sensitive element melts, the shutter is moved into a closing position by the spring and the galvanic isolation between the varistor and the second external contact is obtained.

In contrast to conventional varistor components where gravitational energy is utilized to displace the fuse's material which may not be displaced at all if the molten material cannot flow away. The functionality of the varistor component's releasing device is practically any time and in any position guaranteed and the response time of the releasing device is drastically reduced.

It is possible that the varistor component further comprises a linear guide rail. The shutter can be arranged in the guide rail.

The guide rail ensures the correct transition along the straight line and prevents a deviation of the shutter while moving. The guide rail can confine the shutter to a plane parallel to the side plane of the varistor. Further the guide rail can realize a tunnel confining the shutter to a one dimensional pathway. The tunnel can have a mainly circular cross section or a rectangular, such as a quadratic, cross section.

It is possible that the shutter is a slider. The heat sensitive element can be a metallic body extending through the guide rail and through the shutter and electrically connecting the varistor to the second external contact.

The heat-sensitive element can be a metallic body, e.g., a bold or a cylinder-shaped body, extending through holes in the guide rail. Further, the heat-sensitive element electrically connects the varistor to the second external contact.

The heat-sensitive element can have a longitudinal direction and, e.g., rod shaped. The heat sensitive element can be arranged in such a way that its longitudinal direction is mainly perpendicular to the straight line that defines the possible moving direction of the shutter. Further, the longitudinal direction of the heat-sensitive element can be parallel to a side plane of the varistor.

The heat-sensitive element can be a conductor segment electrically connected to the second external contact. The heat-sensitive element blocks the shutter which is driven by the spring. When the critical temperature is reached, then the heat-sensitive element melts and cannot withstand the spring's force and the shutter is moved in such a way along the straight line that the shutter, i.e., translates with respect to the hole in the guide rail in such a way that dielectric material of the shutter fully closes the hole in the guide rail.

The mentioned geometry of the system is simple. Thus, the risk of jamming the shutter within the guide rail is reduced.

The spring can be a coil spring or a spiral spring. However, a coil spring is preferred.

It is possible that the varistor component further comprises a third external connection. Under normal operation conditions, the third external connection is electrically separated from the first external contact and from the second external contact. If the zone of normal operation conditions is left and the releasing device is activated, then it is possible that the shutter removes the material of the heat-sensitive element from the path in such a way that the still conducting material of the heat-sensitive element establishes an electrical connection between the second external contact and the third external contact while the first external contact and the varistor are electrically separated from the second external contact and from the third external contact. By providing an electrical connection between the second external contact and the third external contact, an indicator of the circuit environment, e.g., an LED, can be switched on indicating the activation of the releasing device and indicating an error in the external circuit environment leading to the activation of the releasing device.

It is possible that the first external contact, the second external contact and the third external contact are lead wires or other kind of terminals such as metal strap electrodes. The external contacts extend from a housing of the varistor component or directly from the varistor or the releasing device.

It is possible that the shutter comprises a material consisting of a thermoplastic or a ceramic.

In particular, it is possible that the shutter and the guide rail comprise a ceramic material, e.g., a metal oxide, e.g., an aluminum oxide, e.g., $Al_2O_3$, or a thermoplastic material.

It is preferred that the shutter comprises a dielectric material with a low conductivity and with a high resistance towards high temperatures.

It is possible that the varistor component further comprises a cap. The shutter and the heat-sensitive element are arranged in a cavity and the cap covers the cavity.

Then, the internal mechanics of the varistor component enabling the varistor component to activate the shutter fast and with an improved failure safety is protected from environmental influences. Further, the molten and hot material of the heat-sensitive element cannot leave the cavity and harm the varistor component's environment.

It is possible that the shutter is designed to close the path under abnormal operation conditions independent from the orientation of the varistor component and independent from accelerations applied to the component.

A housing can be arranged at one side of the varistor. The releasing device can be arranged in the housing.

The materials for the housing, the cap and the shutter can be a dielectric material with a resistance against temperatures higher than 230° C. In particular, the housing and the shutter can comprise or consist of ALCP (Aromatic Liquid Cristal Polymer). The spring can comprise or consist of a steel. The external contacts can comprise or consist of Cu (copper) or Ag (silver). The varistor can be a zinc oxide disc shaped varistor sintered at approx. 1100° C.

The guide rail have a mainly cuboid shape with a width in the range of 2 mm to 6 mm, a thickness in the range of 2 to 5 mm and a length in the range between 0.5 mm and 20 mm. In particular, the guide rail can have a width of 4.1 mm, a thickness of 3.5 mm and a length of 9 mm.

The guide rail can have a mainly cuboid shaped hollow space inside, housing the shutter. The dimensions of the hollow space can be: width: 2 mm to 3 mm/thickness: 2 mm to 3 mm/length 7 mm to 8.5 mm. In particular, the hollow space can have a width of 2.5 mm, a thickness of 2.5 mm and a length of 8.2 mm.

The shutter can have a mainly cuboid shape with a width in the range of 0.1 to 10 mm, a thickness in the range of 0.1 to 10 mm and a length in the range between 0.5 mm and 20 mm. In particular, the shutter can have a width of 2.4 mm, a thickness of 2.4 mm and a length of 3.5 mm.

The guide rail can have an open end to allow mounting of the spring and the shutter inside the hollow space.

The guide rail and the shutter can have chamfered edges.

The voltage threshold between normal operation and abnormal operation depends on the heat generation and thus on materials and dimensions of the components.

The second external contact can have a rod shaped body and a bolt shaped head. The rod shaped body is provided for a connection to an external circuit environment. The bold shaped head is provided for a connection to the heat sensitive element. The bold shaped head can have a thickness larger or slightly larger than the thickness of the body.

A method for securing a varistor component as described above comprises actively closing the path by the shutter and electrically separating the varistor from the second external contact.

BRIEF DESCRIPTION OF THE DRAWINGS

The varistor component, the working principles of the component and details of preferred embodiments are shown in the accompanied schematic figures.

DETAILED DESCRIPTION OF ILLUSTRATIVE EMBODIMENTS

Figure 1:
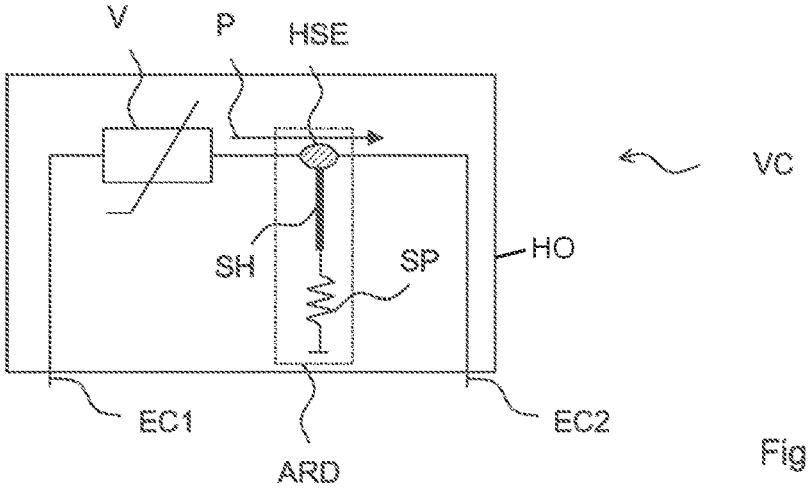
FIG. 1 shows the working principle of the varistor component.

FIG. 1 shows the basic working principle of the varistor component VC. The varistor component VC has a varistor V, a first external contact EC1 and a second external contact EC2. The varistor V is electrically connected in series between the first external contact EC1 and the second external contact EC2 under normal operation conditions. The heat-sensitive element HSE is electrically connected between varistor V and the second external contact EC2 and arranged in the path P indicated by the arrow. The varistor component VC further comprises a shutter SH as part of the active releasing device ARD. The varistor V and the release device ARD can be placed in a housing HO.

Under normal operation conditions, the heat-sensitive element HSE is solid and electrically connects the varistor V to the second external contact EC2. However, when the temperature of the heat-sensitive element HSE exceeds a previously chosen limit, then the heat-sensitive element HSE melts and the shutter SH actively closes the path P and electrically separates the varistor V from the second external contact EC2. The shutter SH can be driven by a spring SP.

The fact that the shutter SH is actively driven reduces the response time of the shutdown of the varistor component and increases the reliability of the varistor component.

Figure 2:
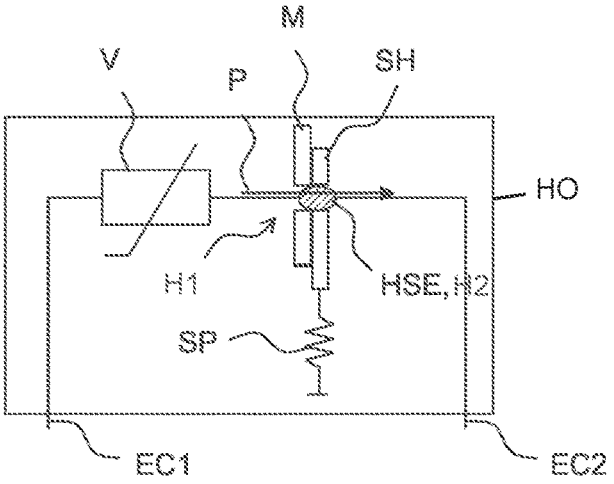
FIGS. 2 and 3 show an embodiment where a hole of the shutter is moved relative to a hole of a mask when the releasing device is activated.
Figure 3:
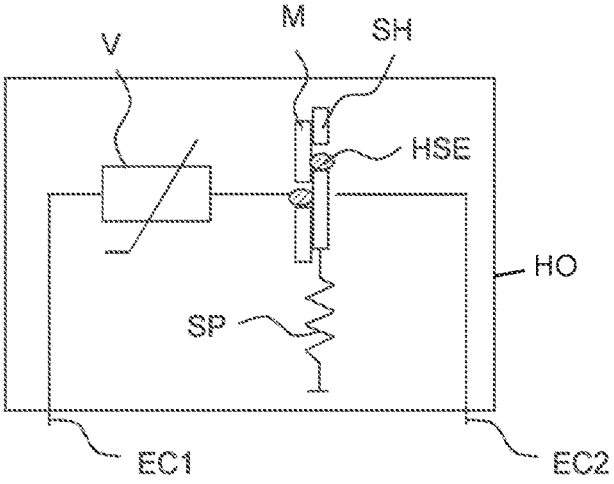

FIGS. 2 and 3 illustrate the working principle of an embodiment where the varistor component has a first hole H1 in a mask M and a second hole H2 in the shutter SH. The heat-sensitive element HSE is arranged in the two holes establishing the current path P. When the releasing device is activated (FIG. 3), the heat-sensitive element HSE melts and cannot further withstand the spring's SP force. Thus, the shutter is moved and the hole H2 of the shutter is moved relative to the hole H1 in the mask M and the path is blocked leading to the electrical separation of the varistor V from the second external contact EC2.

It is preferred that the shutter SH, e.g., a segment without a hole, fully closes the hole in the mask M in such a way that residual material of the melted heat-sensitive element HSE cannot establish an electrical connection between the varistor V and the second external contact EC2.

Figure 4:
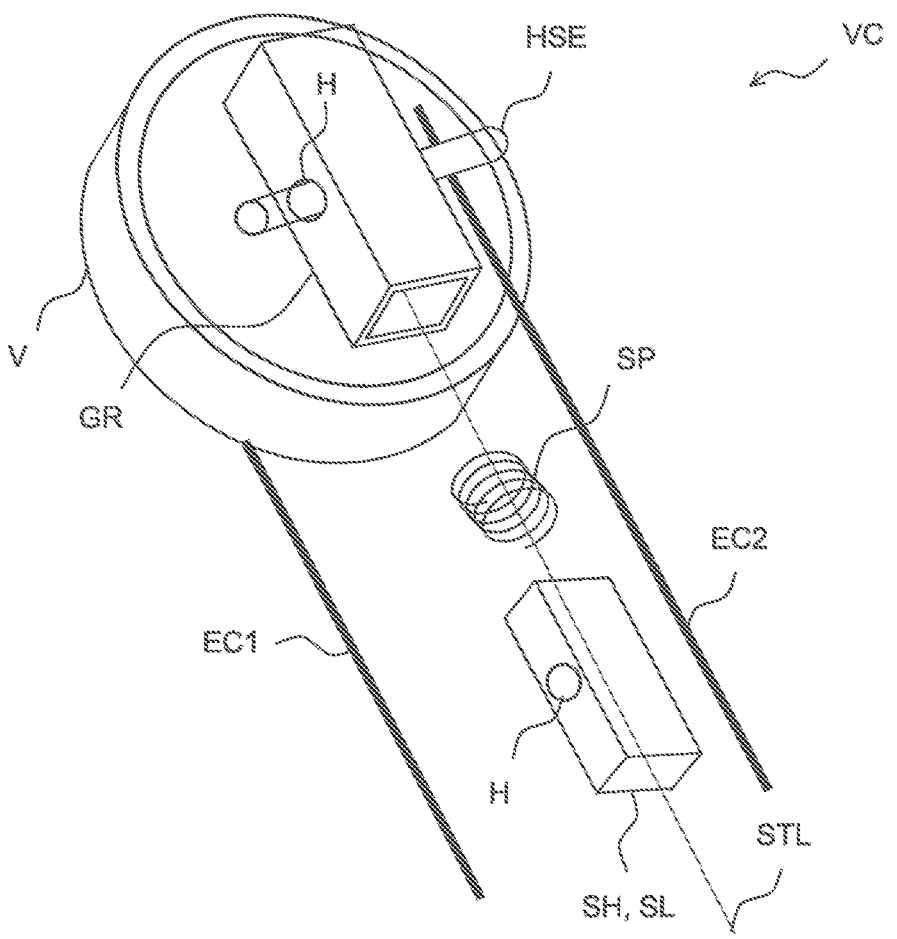
FIG. 4 shows a perspective view of an embodiment with a cuboid shaped guide rail.

FIG. 4 shows an exploded view of an embodiment where shutter SH is a mainly cuboid shaped slider SL with a hole H or a notch. The guide rail GR has also a mainly cuboid shape and houses the slider SL and the spring SP. During normal operation the heat-sensitive element HSE is a bolt that extends through the two holes in the rail (one hole at each side) and through the hole H of the slider SL. The rail GR establishes the mask. The mask and the shutter have such a geometrical shape that the probability that remaining material of the heat-sensitive element HSE maintains an electrical connection is reduced.

The heat-sensitive element HSE has mainly the shape of a cylinder and is in mechanical contact with the walls of the guide rail GR and the shutter SH and is in contact to a wire electrically connected to the second external contact EC2. While the heat-sensitive element HSE is solid, the element holds the shutter SH in the open position with the shutter's hole H arranged directly over the hole H of the guide rail GR. The heat-sensitive element HSE establishes the electrical contact between the varistor and the second external contact EC2.

When the temperature of the heat-sensitive element HSE exceeds a critical temperature and the heat-sensitive element melts, then the spring SP pushes the shutter SH along the straight line STL and the electrical contact is discontinued.

The external contact EC2 can have a rod shaped body and a bolt shaped head thicker than the rod shaped body. The bolt shaped head can have a rectangular cross section to be connected to the heat sensitive element HSE.

Figure 5:
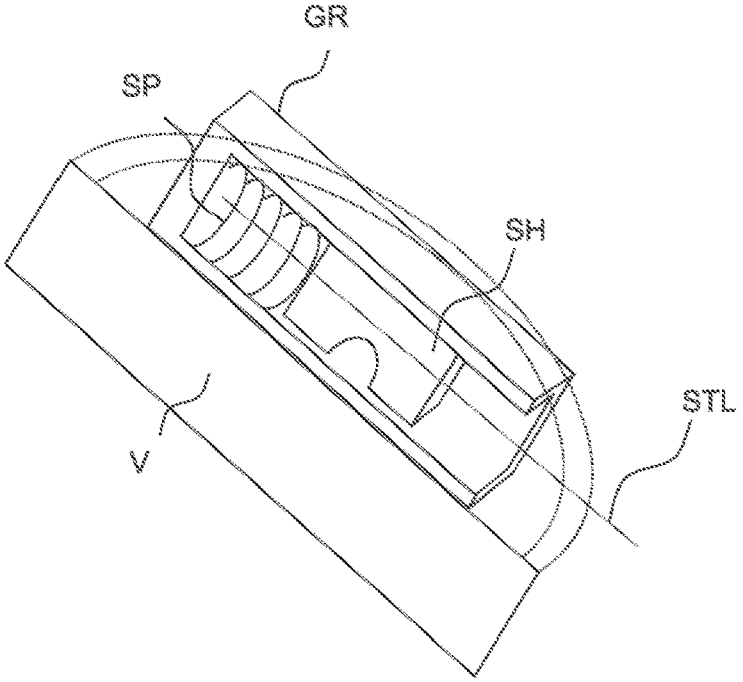
FIG. 5 shows a perspective view of a cross section through the guide rail.

FIG. 5 shows a perspective view of a cross section through the guide rail GR. The guide rail's body is hollow and houses the Spring SP and the shutter SH. The spring SP is under stress pushing against the shutter SH under normal operating conditions. The heat-sensitive element (not shown in FIG. 5) holds the shutter in its position. When the heat-sensitive element melts the resistance against the pushing force of the spring SP ends and the spring SP pushes the shutter SH to interrupt the electrical connection between the varistor V and the second external contact EC2 (not shown in FIG. 5)

Figure 6:
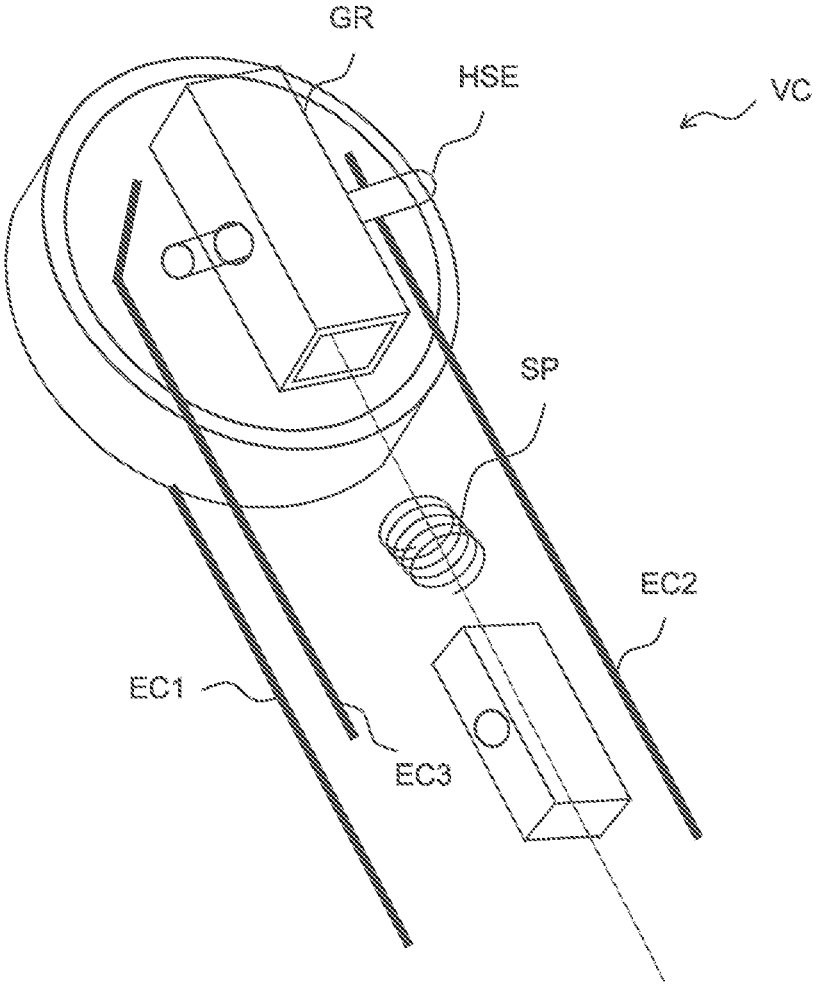
FIG. 6 shows a perspective view of a varistor component with a third external contact.

FIG. 6 shows an embodiment where the varistor component VC has a third external contact EC3 that is electrically connected to a metallization. Under normal operation conditions, the third electrical contact EC3 is electrically connected to the second external contact EC2. However, once the heat-sensitive element HSE is molten, the residual material can electrically disconnect the third external contact EC3 from the second external contact EC2 to indicate the activation of the active release device ARD to an external circuit environment.

An optical indicator OI, such as a LED, can be used to display whether the mode of operation is normal or abnormal. An LED connected to the third external contact can be deactivated when the releasing device is activated.

However, it is also possible that during normal operation a galvanic connection between the third external contact EC3 and a connection selected from the first EC1 and the second external contact EC2 exists during normal operation that is interrupted by the activation of the releasing device. Then, is possible that an active LED indicates normal operation and a deactivated LED indicated an error.

Figure 7:
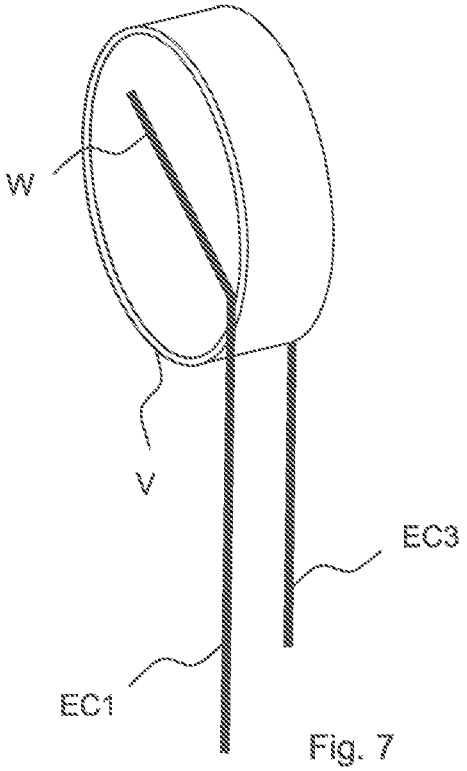
FIG. 7 shows a perspective view of the back of the varistor and its electrical connection to the first external contact.

FIG. 7 shows the backside of the varistor V with a wire W attached to its backside establishing the connection between the varistor V and the conductor of the external connection EC1.

Figure 8:
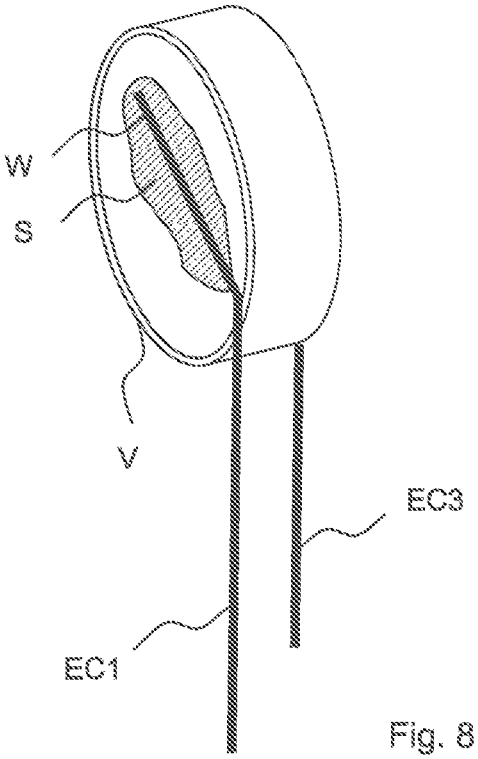
FIG. 8 shows an embodiment where the first external contact is soldered to the back of the varistor.

FIG. 8 shows a preferred embodiment of the backside of the varistor V where the wire W is mechanically and electrically connected to the backside of the varistor V using a solder material S.

Figure 9:
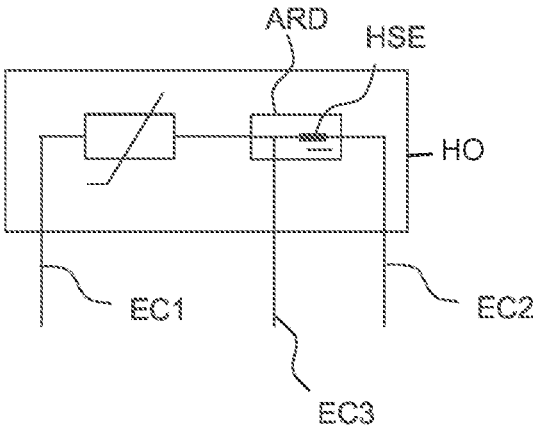
FIGS. 9 and 10 indicate the working principles of the third external contact.
Figure 10:
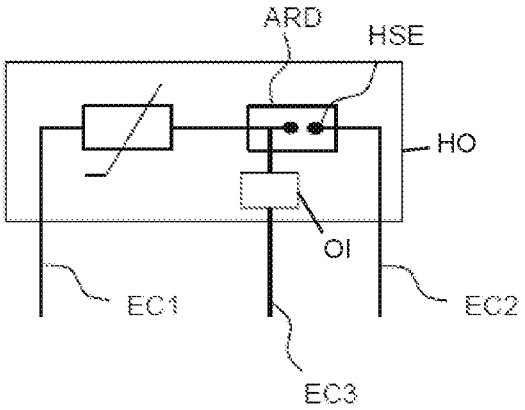

FIGS. 9 and 10 illustrate the basic principle of the third external contact EC3. The third external contact EC3 is electrically connected to the second external contact EC2 during normal operation as the heat-sensitive element HSE is in its position to connect the varistor to the second external contact EC2. FIG. 10 illustrates the situation after activation. The material of the heat-sensitive element HSE is removed from its original position. The electric path between the varistor and the external contact EC2 is blocked (open circuit) and material of the heat-sensitive element HSE no longer electrically connects the second external contact EC2 to the third external contact EC3.

The varistor component can have additional elements such as additional shutters, fuses, springs, electrical connections, and the housing can have a polygon shape, e.g., a rectangular shape basic area. The shutter can be a rotating shutter or a shutter with a linear movement.

The invention claimed is:

1. A varistor component comprising:

a first external contact;

a second external contact;

a third external contact;

a varistor electrically connected to the first external contact;

a path between the varistor and the second external contact;

an active releasing device having a shutter and a heat sensitive element, wherein, under abnormal operation conditions, the heat sensitive element is configured to release the shutter, and the shutter is configured to move along a straight line and close the path between the varistor and the second external contact; and a linear guide rail, wherein the shutter is arranged in the guide rail, wherein the heat sensitive element is a metallic body extending through the guide rail and through the shutter and electrically connecting the varistor to the second external contact, wherein the shutter is a mainly cuboid shaped slider with a hole or a notch, wherein the guide rail has a mainly cuboid shape and houses the slider and an element configured to exert a force onto the shutter, wherein, under normal operation conditions, the heat sensitive element is a bolt that extends through two holes in the guide rail—with one hole at each side—and through the hole of the slider, wherein the guide rail establishes a mask, and wherein the mask and the shutter have such a geometrical shape that a probability that remaining material of the heat sensitive element maintains an electrical connection is reduced.

2. The varistor component of claim 1, where the heat sensitive element is a fuse and has a conducting material with a melting point.

3. The varistor component of claim 1, wherein the element is a spring.

4. The varistor component of claim 1, wherein the shutter and the guide rail comprise a ceramic material, a metal oxide, an aluminum oxide, or a thermoplastic material.

5. The varistor component of claim 1, wherein the first-to-third external contacts are lead wires or metal strap electrodes.

6. The varistor component of claim 1, wherein the shutter comprises a ceramic material, a metal oxide, an aluminum oxide, or a thermoplastic material.

7. The varistor component of claim 1, wherein the shutter is designated to close the path, under the abnormal operation conditions, independent from an orientation of the varistor component.

8. A method for securing the varistor component of claim 1, the method comprising:

actively closing, under the abnormal operation conditions, the path by the shutter thereby electrically separating the varistor from the second external contact.

9. The varistor component of claim 1, wherein the heat sensitive element is a solder with a melting temperature between 185° C. and 230° C.

10. The varistor component of claim 1, wherein the heat sensitive element is a SnBi alloy or SnAgCu alloy solder paste or solder wire.

11. The varistor component of claim 1, wherein the element is a thermo-expansion material.

12. The varistor component of claim 1, wherein the element is a memory metal.

13. The varistor component of claim 1, wherein the shutter comprises a dielectric material with a high temperature resistance relative to a temperature resistance of the heat sensitive element.

14. The varistor component of claim 1, further comprising a housing, wherein the releasing device is located in the housing.

15. The varistor component of claim 1, wherein the optical indicator is an LED.

16. The varistor component of claim 1, wherein, under the normal operation conditions, the heat sensitive element electrically connects the second external contact to the third external contact, and wherein, under the abnormal operation conditions, the heat sensitive element is configured to electrically disconnect the second external contact from the third external contact.

17. The varistor component of claim 16, further comprising an optical indicator connected to the third external contact, wherein the optical indicator is configured to be activated under the normal operation conditions and deactivated under the abnormal operation conditions.

* * * * *